United States Patent [19]

Lillie

[11] Patent Number: 4,848,325

[45] Date of Patent: Jul. 18, 1989

[54] KNEE REHABILITATION RESTRAINT

[75] Inventor: Jean L. Lillie, Sioux City, Iowa

[73] Assignee: Iowa State Research Foundation, Inc., Ames, Iowa

[21] Appl. No.: 125,890

[22] Filed: Nov. 27, 1987

[51] Int. Cl.[4] ..... A61H 1/02

[52] U.S. Cl. ..... 128/25 R; 272/96

[58] Field of Search ..... 128/25 R, 25 B, 132, 128/133, 134, 80 R, 77, 78, 82, 83, 88, 89 R, 845; 272/96, 127, 145, 125, 143, 62, 144; 5/60, 69, 80, 431, 443; 269/328, 322; 297/361, 354, 356, 423, 433

[56] References Cited

U.S. PATENT DOCUMENTS

| | | | |
|---|---|---|---|
| 1,517,915 | 12/1924 | Masland | 128/87 R |
| 2,722,692 | 11/1955 | Dempster | 5/443 |
| 3,203,416 | 8/1965 | Arrigo | 128/134 |
| 3,244,389 | 4/1966 | Wilkins | 297/423 |
| 3,759,252 | 9/1973 | Berman | 269/328 X |
| 3,933,154 | 1/1976 | Cabansag | 128/134 |
| 4,181,297 | 1/1980 | Nichols | 128/132 R X |
| 4,265,232 | 5/1981 | Stonich | 128/133 |
| 4,320,749 | 3/1982 | Highley | 128/83 |
| 4,323,080 | 4/1982 | Melhart | 128/774 |
| 4,355,633 | 10/1982 | Heilbrun | 272/125 X |
| 4,373,709 | 2/1983 | Whitt | 269/328 |
| 4,390,015 | 6/1983 | Clements | 128/80 |
| 4,407,277 | 10/1983 | Ellison | 128/82 |
| 4,681,309 | 7/1987 | Lechner | 269/328 |

FOREIGN PATENT DOCUMENTS

| | | | |
|---|---|---|---|
| 516651 | 1/1953 | Belgium | 128/84 R |
| 74683 | 8/1917 | Switzerland | 128/25 R |

*Primary Examiner*—Richard J. Apley
*Assistant Examiner*—Howard Flaxman
*Attorney, Agent, or Firm*—Zarley McKee, Thomte, Voorhees & Sease

[57] ABSTRACT

A knee rehabilitation device is provided and includes a base, a pair of elongated posts extending upwardly from the base and having opposite upper and lower ends, and an upper and lower restraint each having opposite sides releasably secured to the pair of posts. The posts have a plurality of holes extending along the length thereof. Each side of each restraint has a threaded aperture therein. Threaded shafts extend through one of the holes along the posts and are threadably received in the apertures of the restraints, such that the spacing between the upper and lower restraints is selectively adjustable, thereby selectively limiting the degree of movement of a person's leg between the upper and lower restraints. The restraints are also pivotal about the axis of the shafts so that the restraints can be positioned substantially parallel to the person's leg when the leg engages the restraint.

15 Claims, 1 Drawing Sheet

KNEE REHABILITATION RESTRAINT

BACKGROUND OF THE INVENTION

It is necessary and desirable for a person to rehabilitate his/her knee following injury, surgery or other medical problems. Such rehabilitation often requires that the individual not exceed a certain range of motion during extension and flexion of the knee joint.

Therefore, a primary objective of the present invention is the provision of a knee rehabilitation restraint which limits the range of movement of an individual's knee joint so as to prevent further injury, complications, or problems.

Another object of the present invention is the provision of a knee rehabilitation device in which the spacing between the upper and lower restraints is adjustable.

Another object of the present invention is the provision of a knee rehabilitation device which limits the range of movement of a person's lower leg and knee joint and which can be used with other knee strengthening techniques and devices.

A further objective of the present invention is the provision of a knee rehabilitation device which is safe, durable, and economical to manufacture.

SUMMARY OF THE INVENTION

The knee rehabilitation device of the present invention includes a base, as pair of elongated posts extending upwardly from the base, and upper and lower restraints which are adjustably secured between the posts. The upper restraint has a downwardly presented concave surface and the lower restraint has an upwardly presented concave surface. These upper and lower surfaces are padded for comfort and safety.

Each side of the upper and lower restraints has a threaded aperture therein. The posts have a plurality of holes extending substantially along the length thereof. A wing nut with a threaded shaft fixed thereto is inserted through one of the holes in the post and received in the aperture in each side of the restraints so as to hold the restraints in position on the posts. Thus, the spacing between the upper and lower restraints can be selectively adjusted such that the range of movement of a person's leg is selectively limited. Also, the upper and lower restraints are pivotal about the threaded shafts so as to be substantially parallel with the leg when the leg engages the respective restraint.

The knee rehabilitation device further includes a handle secured to the upper ends of the posts and a plurality of removable or collapsible wheels mounted to the bottom of the base for facilitating movement of the device from one location to another. Rubber studs are also provided on the base to keep the device from sliding when the wheels are removed or collapsed.

DETAILED DESCRIPTION OF THE DRAWINGS

Figure 1:
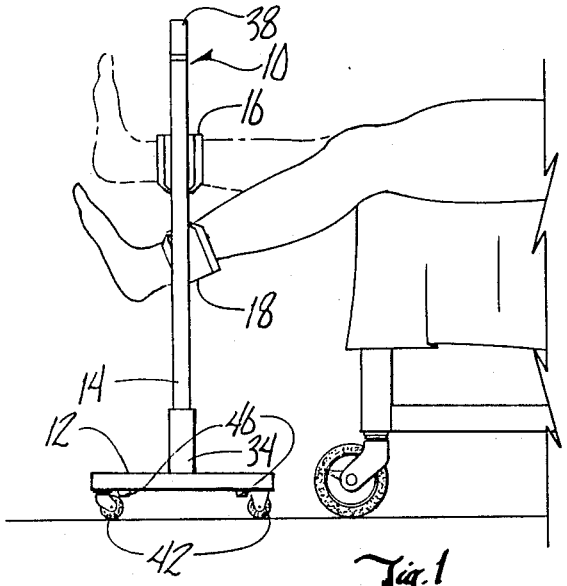
FIG. 1 is a side elevational view showing the knee rehabilitation device of the present invention in use.

The knee rehabilitation device of the present invention is generally designated in the drawings by the reference numeral 10. The device includes a base 12, a pair of posts 14 extending upwardly from base 12, and upper and lower restraints 16 and 18, respectively, extending between posts 12 and being adjustably secured thereto.

Figure 3:
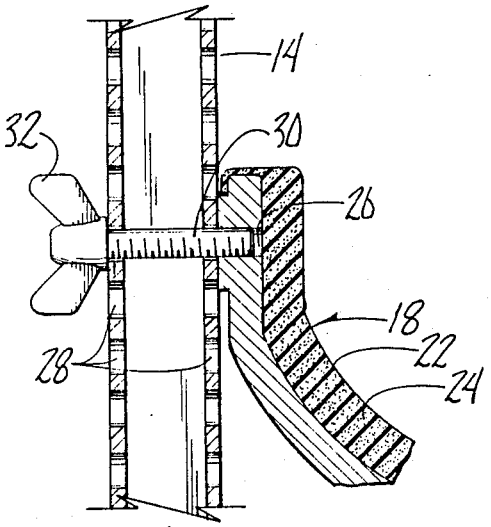
FIG. 3 is an enlarged sectional view taken along lines 3—3 of FIG. 2.
Figure 2:
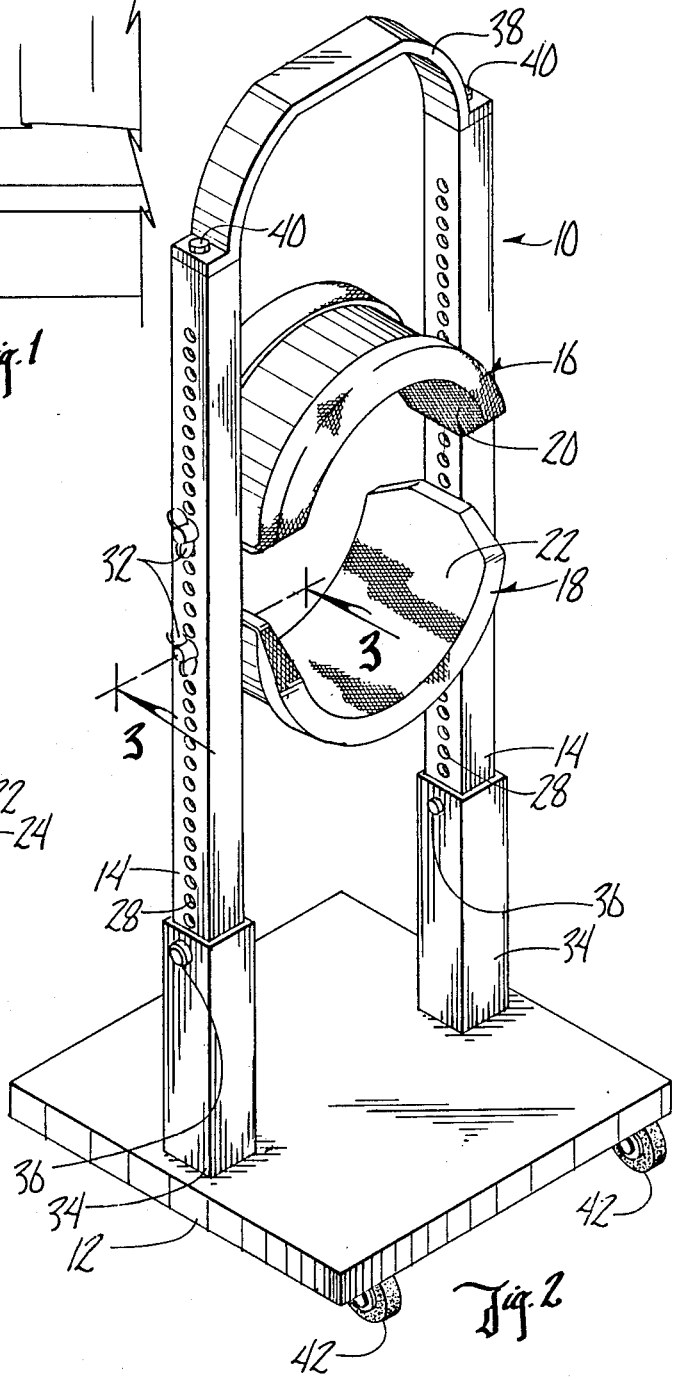
FIG. 2 is a perspective view of the knee rehabilitation device.

Upper restraint 16 includes a downwardly presented concave lower surface 20. Lower restraint 18 includes an upwardly presented concave upper surface 22. Padding 24 is provided on lower surface 20 and upper surface 22 for comfort and safety. Preferably padding 24 extends around the edges of restraints 16 and 18, as shown in FIGS. 2 and 3.

Each restraint 16 and 18 has opposite sides with a threaded aperture 26 therein. Posts 14 have a plurality of holes 28 extending substantially along the length thereof. A threaded shaft 30 fixed to a wing nut 32 is inserted through one of holes 28 on each post 14 and threadably received within the respective aperture 26 in each side of each restraint 16 and 18. Holes 28 permit the upper and lower restraints to be individually moved along the length of the posts to vary the spacing between the restraints. Accordingly, the spacing between restraints 16 and 18 can be selectively adjusted such that the range of movement of a person's leg can be selectively limited. Restraints 16 and 18 are also pivotal about shafts 30, so that the restraints can be positioned substantially parallel to the user's leg when the leg engages the respective restraint, as seen in FIG. 1.

It is understood that the structure for adjustably connecting restraints 16 and 18 to posts 14 can be varied without departing from the scope of the present invention.

Base 12 includes a pair of spaced apart upright collars 34 which are adapted to receive the lower ends of posts 14. Pins 36 extend through a hole in each collar and one of the aligned holes 28 of posts 14 such that the posts are securely anchored to base 12. Collars 34 and pins 36 also permit the relative height of posts 14 to be adjusted.

Device 10 also includes a handle 38 secured to the tops of posts 14 by screws 40 or the like. Also, a plurality of removable or collapsible wheels 42 may be secured to the bottom of base 12 or the like to facilitate the movement of device 10 from one location to another. Rubber studs 46 are also provided on base 12 to keep the base from sliding when the wheels are removed or collapsed.

In use, upper restraint 16 and lower restraint 18 are positioned along posts 14 at the desired height and with the spacing therebetween set to limit the range of movement of the person's lower leg or knee joint to the desired degree. Restraints 16 and 18 are pivoted so as to be substantially parallel to the user's leg when engaged thereby, and wing nuts 32 are tightened to maintain the restraints in the selected position. The leg is inserted through the opening defined by the upper and lower restraints. It is then moved repetitively upwardly and downwardly between the restraints. As seen in FIG. 1, device 10 is placed near the ankle or lower leg of the user. Knee strengthening devices may be used simultaneously with the knee rehabilitation device of the present invention or the device may be used by itself to facilitate isometric strengthening.

From the foregoing, it can be seen that the device of the present invention accomplishes at least all of the stated objectives.

What is claimed is:

1. A knee rehabilitation device, comprising: a base means for supporting the device on a substantially horizontal surface, a pair of elongated posts extending upwardly from the base and having upper and lower ends;

opposing upper and lower restraints having opposite sides releasably secured to the pair of posts so as to define an opening therebetween through which a person's lower leg is receivable such that the restraints are positioned on opposite sides of the user's by;

fastening means for securing each of the upper and lower restraints to the posts, independent of one another the fastening means being adapted to allow the spacing between the upper and lower restraints to be varied whereby the degree of movement of the person's leg within the opening between the upper and lower restraints is selectively limited.

2. The device of claim 1 wherein the upper restraints has a downwardly presented concave lower surface and the lower restraint has an upwardly presented concave upper surface.

3. The device of claim 2 wherein the lower surface of the upper restraint and the upper surface of the lower restraint are padded.

4. The device of claim 1 wherein each post includes a plurality of holes extending substantially along the length thereof and each side of each restraint includes an aperture therein, the fastening means including a shaft for each side of each restraint, each shaft being removably extendable through one of the holes on the posts and into the aperture in the respective sides of each restraint, so as to secure each restraint in position on the posts and so that the restraints are pivotal about the axis of the shafts.

5. The device of claim 4 wherein shafts of the fastening means are externally threaded and the apertures in the sides of the restraints are internally threaded, the fastening means further including gripping means for tightening the fastening means as the shafts are threadably mated with the respective apertures whereby the restraints are held in a fixed postiion with respect to the posts.

6. The device of claim 1 further comprising a pair of hollow upright collars on the base, each collar being adpated to receive the lower end of one of the posts.

7. The device of claim 1 further comprising a carrying handle secured at the upper ends of the posts.

8. The device of claim 1 further comprising a plurality of wheels secured to and under the base for rolling the device from one location to another.

9. A knee rehabilitation device, comprising: a base means for supporting the device on a substantially horizontal surface a pair of elongated posts extending upwardly from the base and each having upper and lower ends and a plurality of holes extending substantially along the length thereof;

an upper restraint having opposite sides and a downwardly presented concave lower surface;

a lower restraint having opposite sides and an upwardly presented concave upper surface;

said upper and lower restraints opposing one another so as to define an opening therebetween through which a person's lower leg is receivable such that the restraints are positioned on opposite sides of a user's by said upper and lower restraints extending between the posts and each restraint having an aperture in each side thereof which is selectively aligned with one of the holes in the adjacent post, such that the spacing between the upper and lower restraints is selectively adjustable; and shaft means extending through the aligned holes and into the apertures so as to maintain the restraints in position said posts whereby the degree of movement of the person's leg extending through the opening between the upper and lower restraints is selectively limited and so as to allow the restraints to pivot about the axis of the shaft means whereby the restraints are substantially parallel to the person's leg when engaged by the leg.

10. The device of claim 9 wherein the lower surface of the upper restraint and the upper surface of the lower restraint are padded.

11. The device of claim 9 wherein the apertures in the sides of the restraints are internally threaded and the pins are externally threaded, and gripping means are on the shaft means for turning and tightening the shaft means into threadably mating engagement with the apertures, whereby the restraints are maintained in a fixed position with respect to the posts after the restraints have been pivoted to a desired angle.

12. The device of claim 9 further comprising a pair of hollow upright collars on the base, each collar being adapted to receive the lower end of one of the posts.

13. The device of claim 9 further comprising a carrying handle secured to the upper ends of the posts.

14. The device of claim 9 further comprising a plurality of wheels secured to and under the base for rolling the device from one location to another.

15. The device of claim 1 wherein the fastening means are adapted to allow the upper and lower restraints to pivot such that each restraint is disposed substantially parallel to the person's leg when the leg engages the respective restraint.

* * * * *